US009260122B2

(12) United States Patent
Haas et al.

(10) Patent No.: US 9,260,122 B2
(45) Date of Patent: Feb. 16, 2016

(54) MULTISENSOR EVIDENCE INTEGRATION AND OPTIMIZATION IN OBJECT INSPECTION

(75) Inventors: Norman Haas, Mount Kisco, NY (US); Ying Li, Mohegan Lake, NY (US); Charles A. Otto, Lansing, MI (US); Sharathchandra U. Pankanti, Darien, CT (US); Hoang Trinh, Mount Vernon, NY (US)

(73) Assignee: International Business Machines Corporation, Armonk, NY (US)

( * ) Notice: Subject to any disclaimer, the term of this patent is extended or adjusted under 35 U.S.C. 154(b) by 925 days.

(21) Appl. No.: 13/489,489

(22) Filed: Jun. 6, 2012

(65) Prior Publication Data

US 2013/0329049 A1 Dec. 12, 2013

(51) Int. Cl.
*B61L 23/04* (2006.01)
*G06T 7/20* (2006.01)

(52) U.S. Cl.
CPC ..... *B61L 23/042* (2013.01)

(58) Field of Classification Search
CPC ..... B61L 23/042
USPC ..... 348/159, 169; 382/103, 224
See application file for complete search history.

(56) References Cited

U.S. PATENT DOCUMENTS 7,015,954 B1 * 3/2006 Foote et al. ..... 348/218.1
7,764,808 B2 * 7/2010 Zhu et al. ..... 382/104
7,813,528 B2 * 10/2010 Porikli et al. ..... 382/103
7,889,794 B2 * 2/2011 Luo et al. ..... 375/240.16
7,929,804 B2 * 4/2011 Avidan et al. ..... 382/294
8,031,775 B2 * 10/2011 Luo et al. ..... 375/240.16
8,483,431 B2 * 7/2013 Xu et al. ..... 382/103
2003/0048926 A1 * 3/2003 Watanabe ..... 382/103
2003/0118214 A1 * 6/2003 Porikli ..... 382/107
2004/0258307 A1 * 12/2004 Viola et al. ..... 382/190
2005/0134685 A1 * 6/2005 Egnal et al. ..... 348/157
2005/0286738 A1 * 12/2005 Sigal et al. ..... 382/103
2008/0198231 A1 * 8/2008 Ozdemir et al. ..... 348/159

(Continued)

OTHER PUBLICATIONS

Roig et al., "Conditional Random Fields for Multi-Camera Object Detection," ICCV, 2011, pp. 1-8.*

(Continued)

*Primary Examiner* — Christopher S Kelley
*Assistant Examiner* — Kathleen Walsh
(74) *Attorney, Agent, or Firm* — Patrick J. Daugherty; Driggs, Hogg, Daugherty & Del Zoppo Co., LPA

(57) ABSTRACT

Video image data is acquired from synchronized cameras having overlapping views of objects moving past the cameras through a scene image in a linear array and with a determined speed. Processing units generate one or more object detections associated with confidence scores within frames of the camera video stream data. The confidence scores are modified as a function of constraint contexts including a cross-frame constraint that is defined by other confidence scores of other object detection decisions from the video data that are acquired by the same camera at different times; a cross-view constraint defined by other confidence scores of other object detections in the video data from another camera with an overlapping field-of-view; and a cross-object constraint defined by a sequential context of a linear array of the objects, spatial attributes of the objects and the determined speed of the movement of the objects relative to the cameras.

13 Claims, 4 Drawing Sheets

(56) References Cited

U.S. PATENT DOCUMENTS

| | | | | |
|---|---|---|---|---|
| 2009/0092282 | A1* | 4/2009 | Avidan et al. | 382/103 |
| 2009/0316988 | A1* | 12/2009 | Xu et al. | 382/173 |
| 2010/0004804 | A1* | 1/2010 | Anderson et al. | 701/19 |
| 2010/0027846 | A1* | 2/2010 | Xu et al. | 382/107 |
| 2010/0027892 | A1* | 2/2010 | Guan et al. | 382/203 |
| 2011/0115921 | A1* | 5/2011 | Wang et al. | 348/187 |
| 2011/0157389 | A1* | 6/2011 | McClellan | 348/222.1 |
| 2011/0200230 | A1* | 8/2011 | Luke et al. | 382/103 |
| 2011/0228984 | A1* | 9/2011 | Papke et al. | 382/103 |
| 2011/0279685 | A1* | 11/2011 | Alahi et al. | 348/187 |
| 2012/0044355 | A1* | 2/2012 | Jamtgaard et al. | 348/159 |
| 2012/0314064 | A1* | 12/2012 | Liu et al. | 348/143 |

OTHER PUBLICATIONS

Li et al., "Component-Based Track Inspection Using Machine-Vision Technology," ICMR, 2011, pp. 1-8.*

Babenko, Visual Inspection of Railroad Tracks, PhD Thesis, 2009, University of Central Florida, Orlando, Florida, 113 pp.

Gilbert and A. Jajaddini, High speed video Inspection of joint bars using advanced image collection and processing techniques, Proc. of World Congress on Railway Research, 2008, ICMR 2011, 4 pp.

Edwards et al, Advancements in Railroad Track Inspection Using Machine-Vision Technology, AREMA Conference Proceedings on American Railway and Maintenance of Way Association, 2009, Urbana, IL, 30 pp.

Hsieh et al, Visual Recognition System of Elastic Rail Clips for Mass Rapid Transit Systems, Proceedings of ASME/IEEE Joint Rail Conference and Internal Combustion Engine Spring Technical Conference, 2007, Pueblo, Colorado, 7 pp.

Ying Li et al, Component-Based Track Inspection Using Machine-Vision Technology, ICMR, 2011, 8 pp.

Singh et al, Autonomous Rail Track Inspection using Vision Based System, IEEE International Conference on Computational Intelligence for Homeland Security and Personal Safety, 2006, Alexandria, VA, 4 pp.

Roig et al, Conditional Random Fields for Multi-Camera Object Detection, ICCV, 2011, 8 pp.

Cai et al, Tracking Human Motion Using Multiple Cameras, ICPR, 1996, 5 pp.

Mittal et al, Unified Multi-camera Detecion and Tracking Using Region-Matching, IEEE Workshop on Multi-Object Tracking, 2001, 8 pp.

Eshel et al, Homography Based Multiple Camera Detection and Tracking of People in a Dense Crowd, CVPR 2008, 8 pp.

Mermec Group, Track Inspection Systems, TSIS, 2009, 1 page.

Aurora, Productivity, budgeting, safety—they all depend on the quality of your track, 2001-2009, Georgetown Rail Equipment Company, 1 page.

Railvision, Trackvue, Nov. 2010, 3 pp.

* cited by examiner

MULTISENSOR EVIDENCE INTEGRATION AND OPTIMIZATION IN OBJECT INSPECTION

TECHNICAL FIELD OF THE INVENTION

Embodiments of the present invention relate to detecting and analyzing objects in video image data through automated video analytics systems.

BACKGROUND

Automated systems may use video analytic systems and processes to distinguish objects of interest that are visible within the video data from other visual elements, and to thereby enable detection and observation of said objects in processed video data input. Such information processing systems may receive images or image frame data captured by video cameras or other image capturing devices, wherein the images or frames are processed or analyzed by an object detection system in the information processing system to identify objects within the images.

The image data for the identified objects may also be analyzed for attributes of the objects, including defects or irregularities associated with the objects. For example, object detection systems may identify objects of interest such as a railroad track and its components (e.g., ties, tie plates, anchors, joint bars, etc.) and use a variety of automated processes to attempt to determine and report if defects or irregularities exist with respect to said objects such as, but not limited to, missing ties, missing spikes, damaged joint bars, damaged rails, etc. Automatic vision-based rail inspection systems may provide more efficiency and reliable performance than human inspectors when provided high quality images as input. However, such systems may perform poorly, missing or falsely reporting defects, due to image problems that may prevent object identification, such as occlusion and poor lighting conditions.

BRIEF SUMMARY

In one embodiment of the present invention, a method for video analytics object detection optimization includes acquiring video image data over time from synchronized cameras having overlapping views of objects moving past the cameras and through a scene image in a linear array and with a determined speed. A processing unit generates one or more object detections associated with confidence scores within frames of the camera video stream data. The confidence scores are modified as a function of constraint contexts including a cross-frame constraint that is defined by other confidence scores of other object detection decisions from the video data that are acquired by the same camera at different times; a cross-view constraint defined by other confidence scores of other object detections in the video data from another camera with an overlapping field-of-view; and a cross-object constraint defined by a sequential context of a linear array of the objects determined as a function of spatial attributes of the objects, and the determined speed of the movement of the objects relative to the cameras.

In another embodiment, a system has a processing unit, computer readable memory and a tangible computer-readable storage device with program instructions, wherein the processing unit, when executing the stored program instructions, acquires video image data over time from synchronized cameras having overlapping views of objects moving past the cameras and through a scene image in a linear array and with a determined speed. The processing unit generates one or more object detections associated with confidence scores within frames of the camera video stream data. The confidence scores are modified as a function of constraint contexts including a cross-frame constraint that is defined by other confidence scores of other object detection decisions from the video data that are acquired by the same camera at different times; a cross-view constraint defined by other confidence scores of other object detections in the video data from another camera with an overlapping field-of-view; and a cross-object constraint defined by a sequential context of a linear array of the objects determined as a function of spatial attributes of the objects, and the determined speed of the movement of the objects relative to the cameras.

In another embodiment, an article of manufacture has a tangible computer-readable storage device with computer readable program code embodied therewith, the computer readable program code comprising instructions that, when executed by a computer processing unit, cause the computer processing unit to acquire video image data over time from synchronized cameras having overlapping views of objects moving past the cameras and through a scene image in a linear array and with a determined speed. The processing unit thereby generates one or more object detections associated with confidence scores within frames of the camera video stream data. The confidence scores are modified as a function of constraint contexts including a cross-frame constraint that is defined by other confidence scores of other object detection decisions from the video data that are acquired by the same camera at different times; a cross-view constraint defined by other confidence scores of other object detections in the video data from another camera with an overlapping field-of-view; and a cross-object constraint defined by a sequential context of a linear array of the objects determined as a function of spatial attributes of the objects, and the determined speed of the movement of the objects relative to the cameras.

BRIEF DESCRIPTION OF THE SEVERAL VIEWS OF THE DRAWINGS

These and other features of this invention will be more readily understood from the following detailed description of the various aspects of the invention taken in conjunction with the accompanying drawings in which.

Figure 1:
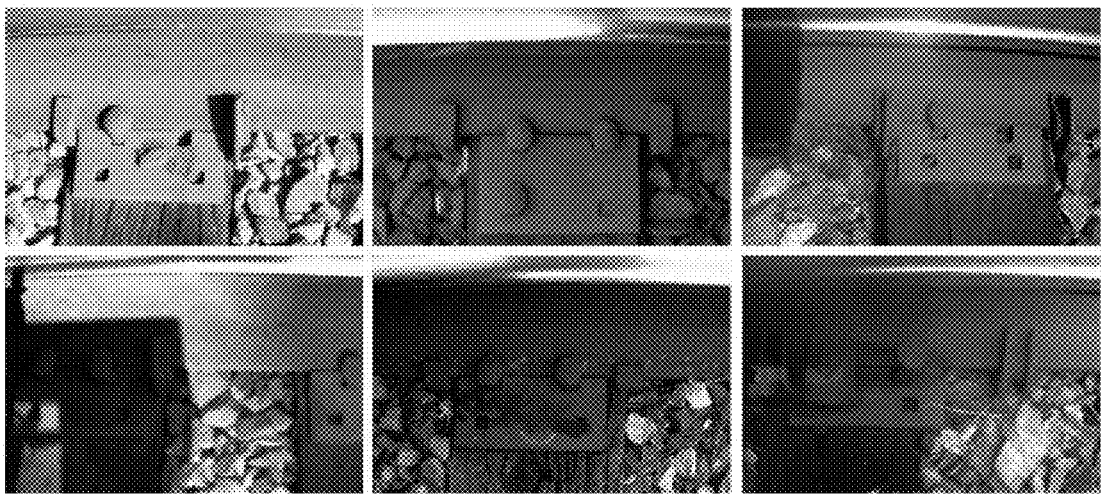
FIG. 1 is a photographic illustration of a plurality of different images of rail way object components.

The drawings are not necessarily to scale. The drawings are merely schematic representations, not intended to portray specific parameters of the invention. The drawings are intended to depict only typical embodiments of the invention, and therefore should not be considered as limiting the scope of the invention. In the drawings, like numbering represents like elements.

DETAILED DESCRIPTION

As will be appreciated by one skilled in the art, aspects of the present invention may be embodied as a system, method or computer program product. Accordingly, aspects of the present invention may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, aspects of the present invention may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain or store a program for use by or in connection with an instruction execution system, apparatus, or device.

A computer readable signal medium may include a propagated data signal with computer readable program code embodied therein, for example, in a baseband or as part of a carrier wave. Such a propagated signal may take any of a variety of forms, including, but not limited to, electro-magnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including, but not limited to, wireless, wireline, optical fiber cable, RF, etc., or any suitable combination of the foregoing.

Computer program code for carrying out operations for aspects of the present invention may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present invention are described below with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

For safety purpose, railroad tracks must be inspected regularly for defects or other design non-compliances. According to a recent report by the Federal Railroad Administration (FRA), rail defects result in thousands of derailments causing casualties and a cost of hundreds of millions dollars each year. Rail inspection generally comprehends a wide variety of tasks, ranging from assessing condition of different railway objects (rails, tie plates, ties, anchors, etc.) to evaluating rail alignments, surfaces and curvatures, to detecting sequence-level track defects. Among these tasks, detecting and locating rail objects is generally important but quite challenging in real-world environments.

Prior art systems generally utilize single-frame object detection methods that are based solely on visual information within individual, single image data frames. Consistent performance in such approaches suffers from a variety of problems. For example, FIG. 1 provides a plurality of different images of rail way tie plates, and comparison of the images reveals a high variability in the respective tie plate appearances that result from different shape, size, camera viewpoint, occlusion and lighting conditions (shadow, lighting quality and strength, etc.). The wide variety of image quality of the tie plate object in these images presents problems in obtaining consistent object analysis from single-frame object detection methods.

Figure 2:
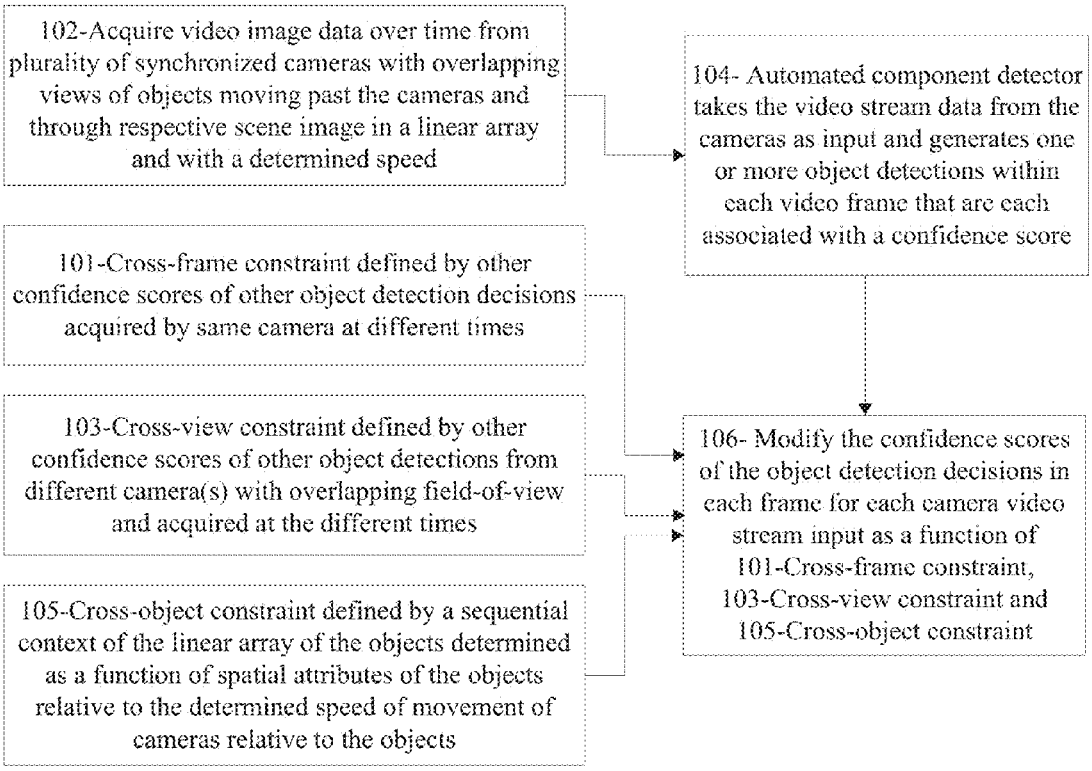
FIG. 2 is a block diagram illustration of an embodiment of a method, process or system for object detection optimization that uses image data from multiple camera views and processes the data as a function of a global optimization framework according to the present invention.

FIG. 2 illustrates an embodiment of a system and method for object detection optimization according to the present invention that uses image data from multiple camera views and processes the data as a function of a global optimization framework. At 102 video image data is acquired from a plurality of synchronized cameras that are each mounted in a fixed location, wherein each camera has an overlapping view with at least one other of the cameras of a scene image at fixed calibration parameters (focal plane, etc.), and wherein the video data is acquired while a linear array of objects moves past the camera and through the scene image with a known or determined speed.

Figure 3:
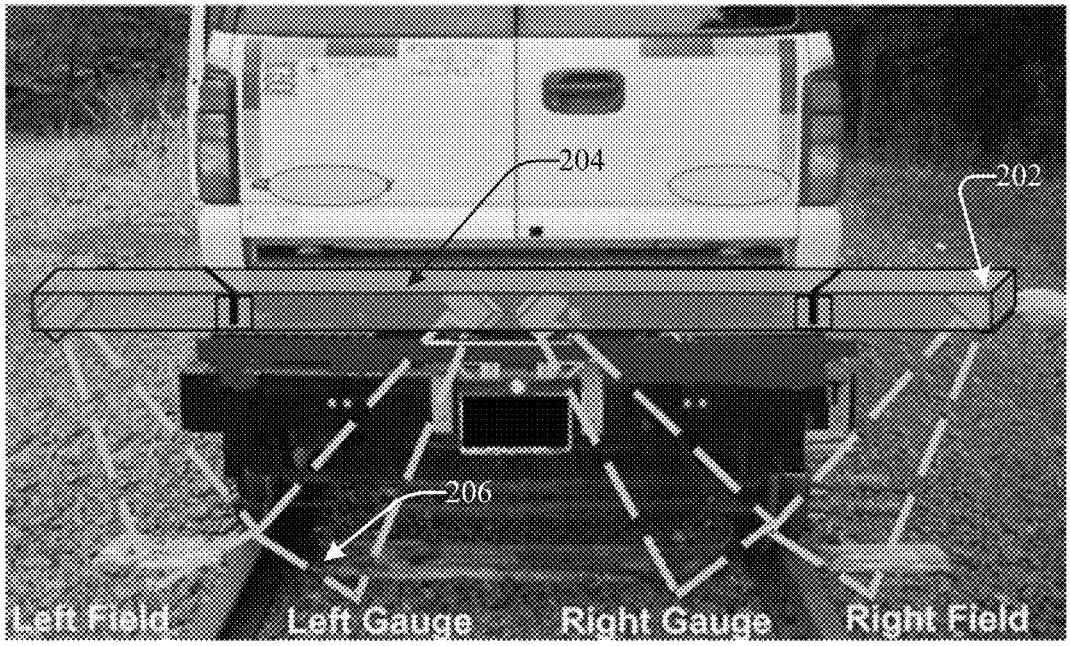
FIG. 3 is a photographic illustration of an embodiment according to the present invention.
Figure 4:
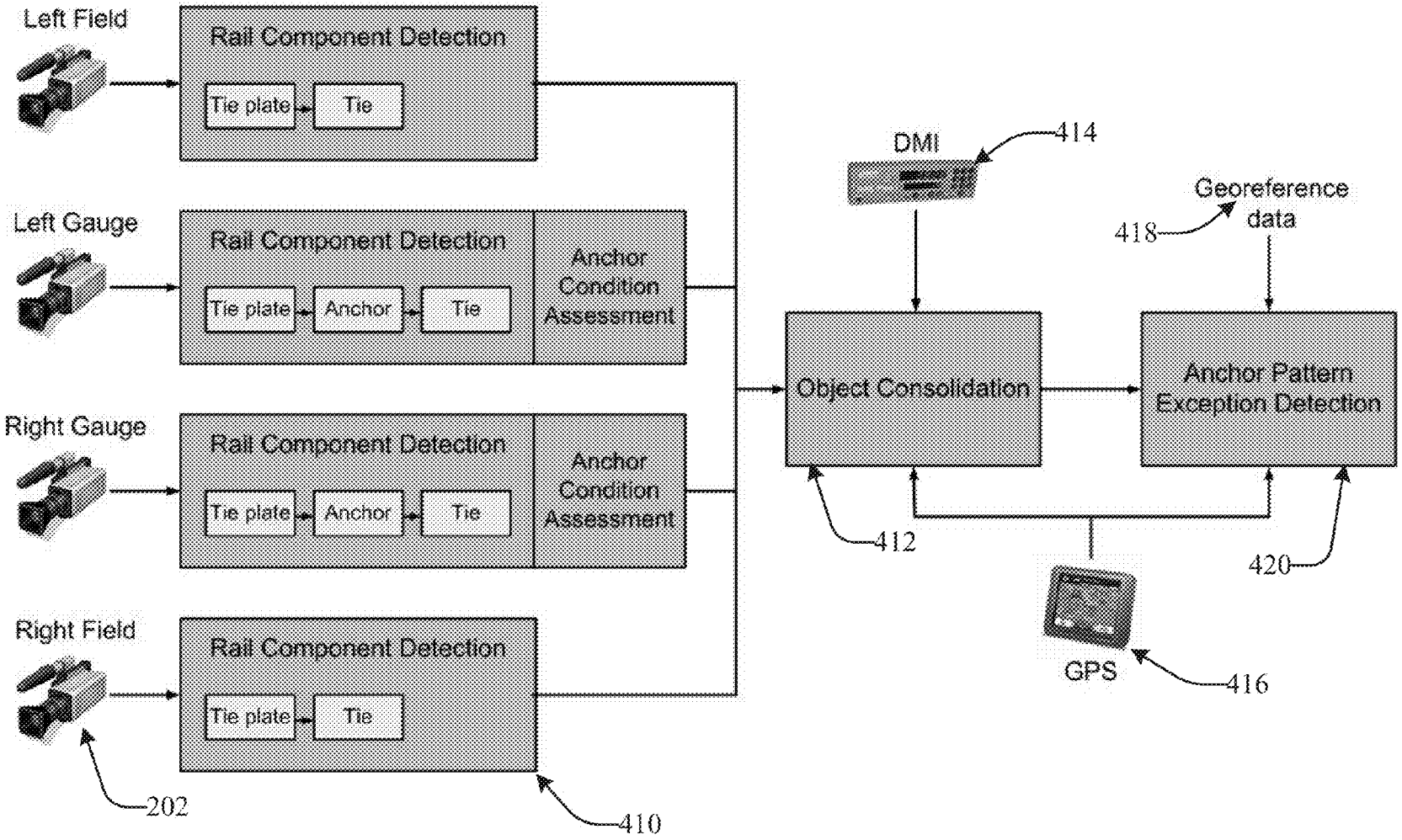
FIG. 4 is a block diagram illustration of an embodiment of a method, process or system according to the present invention.

FIGS. 3 and 4 illustrate one embodiment wherein four cameras 202 are mounted on a vehicle high-rail 204, wherein pairs of the cameras 202 have overlapping fields of view 206 of respective railway rails and the tie plates that hold the rails to the railroad ties. The cameras 202 are arrayed on the vehicle high-rail 204 in a linear array that is generally normal to the rails, and the fixed calibration parameters are chosen to bring into focus one or more of the rails, tie plates, ties, anchors, etc., as the associated vehicle moves at a constant or otherwise known or determined speed over and along the rails while the image data is acquired from the cameras.

Visual evidence from multiple camera views for each object of interest is thereby acquired over time as the cameras 202 are conveyed along the railway track, which is combined and processed as a function of a distance measuring instrument to provide contextual rail object detection. The embodiment leverages cross-object spatial constraints enforced by the sequential structure of rail tracks, as well as the cross-frame and cross-view constraints in camera streams. More particularly, at 104 (FIG. 2) one or more automated component detectors (410, FIG. 4) takes the video stream data from the cameras as input and generates one or more object detections within each video frame that are each associated with a confidence score. In the present example, the objects of interest are one or more of railway ties, rails, plates, ties, anchors, etc., that are visible in each of the acquired images, and a user may selectively configure the embodiment to focus on a particular object of interest as needed.

At 106 the confidence scores of the object detection decisions in each frame for each camera video stream input are modified by an Object Consolidation component 412 (FIG. 4) as a function of contexts of a 101 Cross-frame constraint defined as a function of other confidence scores of other object detection decisions from video data acquired at different times from the camera; a 103 Cross-view constraint defined by other confidence scores of other detections in each of the other cameras having an overlapping field-of-view that are also acquired at the different times; and a 105 Cross-object constraint defined as a function of a sequential context of the objects determined as a function of their spatial attributes relative to the determined/known speed of movement of the cameras relative to the objects.

The speed of movement of the cameras relative to the objects may be known, or in some embodiments determined by a Distance Measurement Instrument (DMI) 414 (FIG. 4) that observes the rate of speed that the linear array of objects is conveyed past the cameras 202. In some embodiments, Global Positioning System (GPS) data is also acquired by a GPS component 416 (FIG. 4), and used as a function of a Georeference data input 418 (FIG. 4) to determine object attributes of concern as a function of geographic reference, for example to indicate "Anchor pattern exception detection" events at 420 of FIG. 4.

More particularly, in the present embodiment, the objects of interest are arrayed in compliance with or define a known or determinable specific linear design or structure relative to each other as they move through the field of view of the cameras along the linear direction. In the present example, the spacing of railway ties and their associated rails, tie plates, anchors, spikes, etc. has a determinable spacing and sequence relative to the linear rails that is enforced by design of the railway structure, and should be around a constant dependent upon the expected construction constraints. Spike head patterns visible within the tie plates and anchor placements are also generally repetitive and predictable based on implementation requirements: for example, the same three-of-four spike holes may be required to be occupied with spikes in each tie under an appropriate standard when the rails are transitioning through a turn, and wherein different recurrent patterns may be required or permitted over straightaways. Anchor placement patterns are likewise predictable based on railway construction standards. This is contrasted with the random, loose, un-determinative relationships of objects to each that may be found in other video analytic applications, wherein each object may occur or act independent of other objects, such as with respect to pedestrians detected within video streams taken from public assembly areas. The present embodiment leverages the known or determined cross-object spatial relationship constraints of the objects relative to each that are enforced by the sequential structure of the rail track components, as well as inter-camera cross-frame constraints and intra-camera cross-view constraints in the camera video streams to improve the object detection confidences at 106.

In one embodiment of the present invention, the modification of the confidence scores at 106 is a global optimization process that selects a set (plurality) of detections for a sequence of multiple objects by optimizing a global energy function incorporating cross-frame, cross-view and cross-object constraints. More particularly, given four streams $\{S_1; \ldots, S_4\}$ of object states, each is the result of applying an object detection module to one of the camera streams for a duration of T. Each $S_k$ consists of a sequence of object states $\{s_k^t, \ldots, s_k^T\}$.

It may be assumed that there is only at most one object state per frame. The approach of the present embodiment may be directly applied to the case where there are multiple object states per frame. Accordingly, embodiments may apply an object detection module to the acquired video image data to generate for each camera a plurality of object detection states that each have different times of frames of the acquired video image data. Those of the plurality of object detection states for each of the different times that have the highest confidence score as optimized by an energy function (which finds a maximum unary potential of an object state as a function of the cross-view spatial constraint and the cross-frame spatial constraint) are selected. These selected object states (having the highest optimized confidence scores) may be used to define an optimal state path for a detection of an object from an initial time to a final time of a duration period comprising the selected object detection states.

Figure 5:
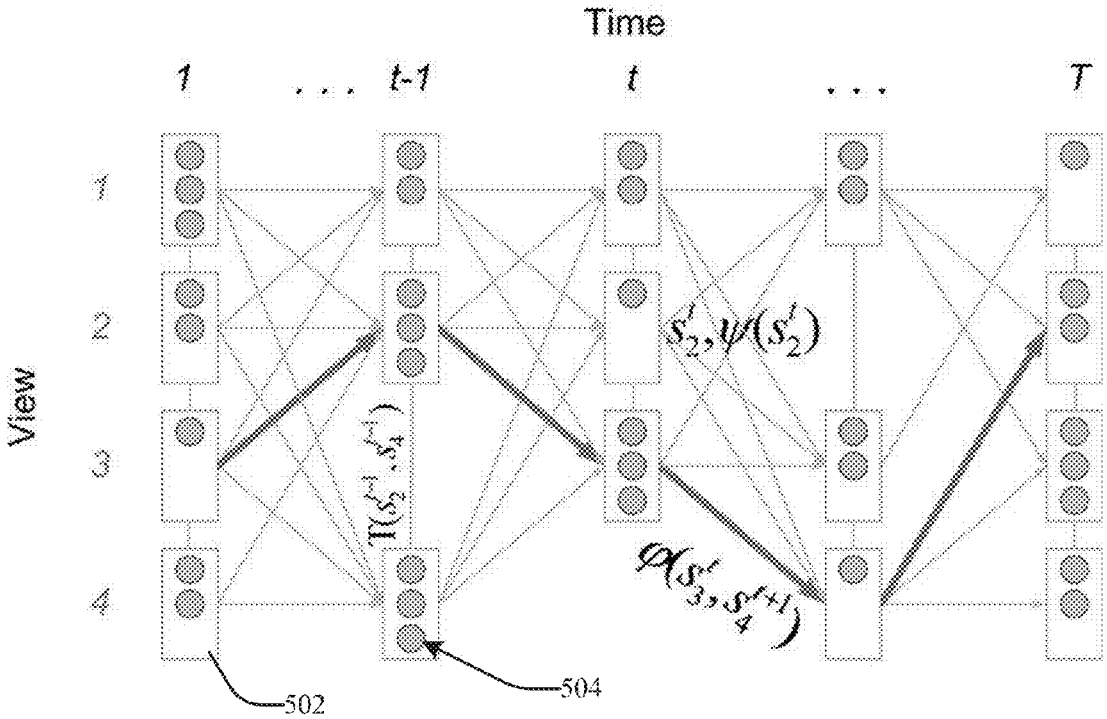
FIG. 5 is a trellis graph illustration of object states according to the present invention.

FIG. 5 is a trellis graph illustration of one example of a railway optimization implementation for the present embodiment. Each column in the graph corresponds to a video frame 502, and each row corresponds to a camera view. Round nodes 504 in the frames 502 correspond to results of an object detector component that indicate true object states (locations) on a particular frame (t) in a particular view (k). It will be noted that the detector may find multiple detections per frame, which results in having multiple states 504 per frame 502. The optimization process 106 goal is to assign an optimal state (or location) to each node (k, t) in the graph, wherein $(x_k^t)$ is the confidence score of adding a node (k, t) to the path, and $s_k^t$ is the object state at node (k, t), which initially is the input object detection.

The present embodiment finds the path from time "1" to time T by selecting a set of states $[S^*=\{s_*^1, \ldots, s_*^T\}]$ optimizing according to the following energy function:

$$S^* = \frac{\text{argmax}E}{s} = \sum_t \psi(s_k^t)\phi(s_k^t, s_l^{t+1}) \quad (1)$$

where $\psi(s_k^t)$ is the unary potential of an object state $(s_k^t)$ determined as a function of a cross-view spatial constraint (defined below), and $\phi(s_k^t, s_l^{t+1})$ is a cross-frame spatial constraint.

Cross-View Constraints.

The present embodiment models the spatial constraints of different object states between different camera views, assuming all camera calibration parameters are fixed (each camera is focused on the objects of interest so as to keep the objects within their focal planes and deliver a stream of images of the objects as the cameras travel over the railway tracks.) Given an object state $\{s_k^t\}$ at view $\{l\}$ follows a Gaussian distribution. This cross-view constraint may be determined as follows according to formulation (2):

$$T(s_k^t, s_l^t) = \max\begin{pmatrix} N(|s_k^t - s_l^t|; \theta_{kl}), \\ N(|s_k^t - s_l^t + \epsilon|; \theta_{kl}) \end{pmatrix} \quad (2)$$

where $\theta_{kl=[\mu_v}(k, l), \Sigma_v(k, l)]$; "$\mu_v$" is a 4×4 matrix of mean values; and "$\Sigma_v$" is a four-by-four covariance matrix. "$\epsilon$" is a cross-object spatial constraint that represents an object spacing constant (for example, spike head, tie, tie plate, anchor, etc.) and may be used in the case that $s_k^t$ and $s_l^t$ do not correspond to the same physical object, but instead an adjacent object in the sequence. It will be appreciated by one skilled in the art that $\theta$ and $\epsilon$ may each be learned from labeled training data.

Accordingly, the unary potential $\psi(s_k^t)$ may be determined according to formulation (3):

$$\psi(s_k^t)=f(s_k^t)\Pi_{l\neq k}T(s_k^t,s_l^t) \quad (3)$$

where $f(s_k^t)$ is the confidence score of object state $s_k^t$ returned by the object detector.

Cross-Frame.

The present embodiment also models the spatial constraints of object states between consecutive frames. For tie plate detection it is assumed that the spacing between consecutive ties in the rail track is a constant. Given state $(s_k^t)$ at frame (t), and $(s_l^{t+1})$ at frame (t+1), wherein (k) and (l) may be different views, there are two possibilities: $(s_k^t)$ and $(s_l^{t+1})$ may correspond to the same physical object, or to two different (adjacent) physical objects.

Accordingly, the present embodiment represents the cross-frame constraints in both those cases by formulation (4) as follows:

$$\Phi(s_k^t, s_l^{t+1}) = \max\begin{pmatrix} (F(|s_k^t - s_l^{t+1}|; \lambda), \\ (F(|s_k^t - s_l^{t+1} + \epsilon|; \lambda) \end{pmatrix} \quad (4)$$

where $\lambda=[\mu_f, \sigma_f, \mu_v, \Sigma_v\ \tau]$, $\langle \mu_f, \sigma_f \rangle$ models the Gaussian distribution of the object state at the next frame given its state at the previous frame. "$\tau$" represents DMI data, F( ) is a distance function that computes a matching score for each pair of object states $(s_k^t, s_l^{t+1})$; and wherein $\mu_f$ and $\sigma_f$ are cross-object spatial constraints that may be learned from labeled training data.

The output of the optimization process at 106 is an optimal set of detected components across a sequence of frames from all camera views, satisfying all the defined temporal and spatial constraints. In one aspect, this is equivalent to a maximum likelihood estimation that maximizes the probability of the joint locations of all detected components, given all the observed data in all frames and all camera views. The present embodiment may utilize two different algorithms: (i) a real-time algorithm that generates results in real time, and (ii) a batch-processing algorithm that may be used when real-time efforts are not required. Both the real-time and batch-processing find the best sequence of states for all objects across a duration of the video stream sequences from all camera views.

Real-Time Algorithm.

In one example of a real-time algorithm, at each time point (t) an original path is determined from time "zero" up to a current time point, given all object states from the beginning time up to the present time point. The confidence scores for every node in the graph are determined via dynamic programming according to formulations (5) and (6):

$$\chi_k^1 = \psi(s_k^1) \quad (5)$$

$$\chi_k^t = \psi(s_k^t)\frac{\max}{j}(\chi_k^{t-1}\phi(s_k^t, s_j^{t-1})) \quad (6)$$

wherein variable $\{j\}$ is a view. At each time point (t) the process further selects an optimal object state $(s_v^t)$ according to formulation (7):

$$v = \arg\frac{\max}{k}(\chi_k^t) \quad (7)$$

The selected object states are then used to infer or update suboptimal object states in other camera views at each time point (t). If no object detection is found at a time point (t), the process restarts at a next time point (t+1).

In one exemplary implementation, the real-time algorithm descried above was shown to perform well at a vehicle speed of 10 miles-per-hour (mph), with a video stream input frame rate of 20 frames-per-second (fps).

Batch Algorithm.

In some embodiments, the selected detections at each time point can be used to infer and update detections at other camera views. More particularly, given a set of object states from time "zero" to a time (T), the batch algorithm computes the optimal path from the zero time up to T by: (i) determining the score for each node in the graph using the real-time algorithm dynamic programming processes (as described above); (ii) for each node, storing the predecessor with which it obtains the optimal score; (iii) at time T the optimal object state is selected; (iv) the selected object state is used to infer or update detections in other camera views at time T; and (v) the process back-tracks to retrieve the stored predecessors at each earlier time point to obtain the full path.

In contrast to the real-time algorithm, the batch algorithm takes into account all available detection information from the beginning to end, and therefore tends to achieve a better prediction than the real-time algorithm, which operates in a more greedy fashion.

In one implementation, the embodiment described above was used to capture video data by running a high-rail vehicle on rail tracks at an average speed of 10 mph while recording track video data and DMI output. The captured videos had a resolution of 640-by-400 pixels and a frame rate of 20 FPS, and the DMI was accurate to 1 foot-per-mile. The test set included challenging issues such as heavy occlusion (debris), and heavy shadow.

Ground truth for tie plates was manually annotated on 6000 video frames (on all four views) for evaluation. A detection was considered correct if the overlapping region between a detection bounding box and a ground truth bounding box of the same component was at least 50% of the ground truth bounding box. These criteria indicated that the present embodiment achieved superior results with respect to tie-plate detection relative to another, prior art single-view detector process, in one aspect successfully inserting missing detections and correcting wrong detections. The single-view detector is not able to detect the object when the tie plates are heavily or even fully occluded or in shadow, whereas by leveraging the contextual and spatial constraints of the object with respect to nearby detections, the present embodiment effectively predicts the correct location despite insufficient visual information for the predicted/occluded object.

Experimental results on rail track-driving data demonstrate that the embodiment achieves superior performance compared to processing each camera data stream independently. However, the embodiment described herein is not limited to implementations in a railway inspection context. Instead, it will be apparent to one skilled in the art that embodiments of the present invention may be deployed in a variety of other implementations that involve linear sequential structures, such as pipelines, subways, bridges, highway and road inspection, etc.

Figure 6:
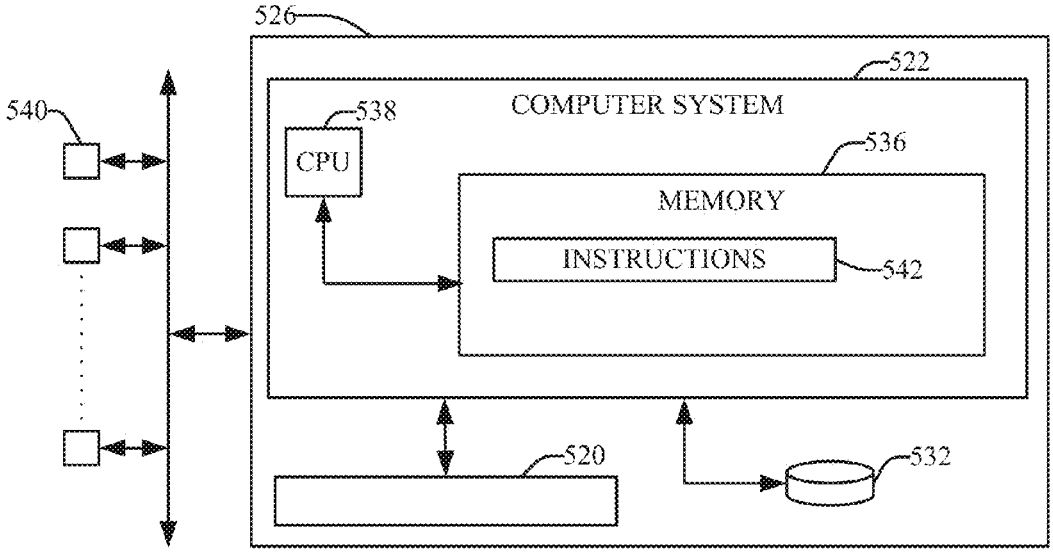
FIG. 6 is a block diagram illustration of a computerized implementation of an embodiment of the present invention.

Referring now to FIG. 6, an exemplary computerized implementation of an embodiment of the present invention includes a computer system or other programmable device 522 in communication with cameras or other video data sources 540 that provide object frame image inputs. Instructions 542 reside within computer readable code in a computer readable memory 536, or in a computer readable storage system 532, or other tangible computer readable storage medium that is accessed through a computer network infrastructure 526 by a processing unit (CPU) 538. Thus, the instructions, when implemented by the processing unit (CPU) 538, cause the processing unit (CPU) 538 to perform video analytics object detection optimization as described above with respect to FIGS. 1-4.

Embodiments of the present invention may also perform process steps of the invention on a subscription, advertising, and/or fee basis. That is, a service provider could offer to integrate computer-readable program code into the computer system 522 to enable the computer system 522 to perform video analytics object detection optimization as described above with respect to FIGS. 1-4. The service provider can create, maintain, and support, etc., a computer infrastructure such as the computer system 522, network environment 526, or parts thereof, that perform the process steps of the invention for one or more customers. In return, the service provider can receive payment from the customer(s) under a subscription and/or fee agreement and/or the service provider can receive payment from the sale of advertising content to one or more third parties. Services may comprise one or more of: (1) installing program code on a computing device, such as the computer device 522, from a tangible computer-readable medium device 520 or 532; (2) adding one or more computing devices to a computer infrastructure; and (3) incorporating and/or modifying one or more existing systems of the computer infrastructure to enable the computer infrastructure to perform the process steps of the invention.

The terminology used herein is for describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising" when used in this specification, specify the presence of stated features, integers, steps, operations, elements, and/or components, but do not preclude the presence or addition of one or more other features, integers, steps, operations, elements, components, and/or groups thereof. Certain examples and elements described in the present specification, including in the claims and as illustrated in the Figures, may be distinguished or otherwise identified from others by unique adjectives (e.g. a "first" element distinguished from another "second" or "third" of a plurality of elements, a "primary" distinguished from a "secondary" one or "another" item, etc.) Such identifying adjectives are generally used to reduce confusion or uncertainty, and are not to be construed to limit the claims to any specific illustrated element or embodiment, or to imply any precedence, ordering or ranking of any claim elements, limitations or process steps.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A computer-implemented method for video analytics object detection optimization, the method comprising executing on a processing unit the steps of:

acquiring video image data over time from a plurality of synchronized cameras having overlapping views of a plurality of objects moving past the cameras and through a scene image in a linear array and with a determined speed;

generating for each camera a plurality of object detection states that each have different times of frames of the acquired video image data within a plurality of frames of the camera video stream data, wherein each of the object detection states are associated with a confidence score;

selecting ones of the plurality of object detection states for each of the different times that have a highest confidence score optimized by using a global energy function to find maximum unary potentials ($\psi(s_k^t)$) of the object detection states as a function of a cross-frame constraint that is defined by other confidence scores of other object detection states from the video data that are acquired by a same one of the cameras at different times from a time of the object detection state, and of a cross-view constraint ($T(s_k^t, s_l^t)$ that is defined by other confidence scores of other object detection states in the video data from another different one of the cameras that has an overlapping field-of-view with the same one camera and that are also acquired at the different times; and defining an optimal state path for a detection of an object from an initial time to a final time of a duration period comprising the selected ones of the plurality of object detection states that have the highest optimized confidence scores; and wherein the unary potentials $\psi(s_k^t)$ are determined according to:

$$\psi(s_k^t)=f(s_k^t)\Pi_{t\neq k}T(s_k^t,s_l^t);$$

where $f(s_k^t)$ is a confidence score of an object state $\{s_k^t\}$ returned by an object detector at view $\{k\}$; and the processing unit determining the cross-view spatial constraint as a function of the unary potential according to:

$$T(s_k^t, s_l^t) = \max\begin{pmatrix} N(|s_k^t - s_l^t|; \theta_{kl}), \\ N(|s_k^t - s_l^t + \in|; \theta_{kl}) \end{pmatrix};$$

wherein $\theta_{kt}=[\mu_v(k, l), \Sigma_v(k,l)]$ for views $\{k\}$ and $\{l\}$;

"$\mu_v$" is a four-by-four matrix of mean values;

$\Sigma_v$" is a four-by-four covariance matrix; and

"$\epsilon$" is a cross-object spatial constraint that represents an object spacing constant defined by a sequential context of the linear array of the objects determined as a function of spatial attributes of the objects relative to the determined speed of the movement of the cameras relative to the objects.

2. The method of claim 1, wherein the processing unit uses the cross-object constraint if the object states $\{s_k^t\}$ and $\{s_l^t\}$ for views $\{k\}$ and $\{l\}$ do not correspond to a same physical object, but instead to an adjacent object in the linear sequence.

3. The method of claim 1, further comprising:

determining the cross-frame constraint $(\Phi(s_k^t, s_l^{t+1})$ according to:

$$\Phi(s_k^t, s_l^{t+1}) = \max\begin{pmatrix} (F(|s_k^t - s_l^{t+1}|; \lambda), \\ (F(|s_k^t - s_l^{t+1} + \in|; \lambda) \end{pmatrix};$$

wherein $\lambda=[\mu_f, \sigma_f, \mu_v, \Sigma_v, \tau]$, $(\mu_f, \sigma_f)$ and models a Gaussian distribution of an object state at a next frame given its state at the previous frame;

"$\tau$" is the determined speed of the movement of the cameras relative to the objects; and F( ) is a distance function that computes a matching score for each pair of object states $(s_k^t, s_l^{t+1})$, given an object state $(s_k^t)$ at frame (t), and $(s_l^{t+1})$ at frame (t+1), wherein (k) and (l) may be different views, and wherein $(s_k^t)$ and $(s_l^{t+1})$ may correspond to a same object or to two different, adjacent objects.

4. The method of claim 3, further comprising defining the optimal state path for the detection of the object by:

determining confidence scores for the object detection states according to real-time dynamic programming formulations:

$$\chi_k^1 = \psi(s_k^1); \text{ and}$$

$$\chi_k^t = \psi(s_k^t)\frac{\max}{j}(\chi_k^{t-1}\phi(s_k^t, s_j^{t-1}));$$

at each time point, selecting an optimal object state $(s_v^t)$ according to formulation:

$$v = \arg\frac{\max}{k}(\chi_k^t);$$

inferring suboptimal object states in other camera views at each time point (t); and if no object detection is found at a time point (t), restarting the steps of determining confidence scores for the object detection states via the real-time dynamic programming formulations and selecting an optimal object state $(s_v^t)$ at a next time point (t+1).

5. The method of claim 4, further comprising defining the optimal state path for the detection of the object by:

determining confidence scores for the object detection states via a batch process that infers and updates detections at other camera views by, given a set of the object states from a starting time to an ending time, computing an optimal path from the starting time to the ending time by:

determining the score for the object detection states using the real-time algorithm dynamic programming steps;

for each of the object detection states, storing a predecessor object detection state that obtains an optimal score;

at the ending time, selecting an optimal object state;

using the selected optimal object state to infer or update detections in other camera views at the ending time; and back-tracking to retrieve the stored predecessor object detection state at each earlier time point to obtain a full path.

6. The method of claim 1, further comprising:

integrating computer-readable program code into a computer system comprising the processing unit, a computer readable memory and a computer readable tangible storage medium;

wherein the computer readable program code is embodied on the computer readable tangible storage medium and comprises instructions that, when executed by the processing unit via the computer readable memory, cause the processing unit to perform the steps of acquiring the video image data over time from the synchronized cameras having the overlapping views of the objects moving past the cameras, generating for each camera the plurality of object detection states that are associated with the confidence scores, selecting the ones of the plurality of object detection states for each of the different times that have the highest optimized confidence scores, and defining the optimal state path for the detection of the object from the initial time to the final time of the duration period.

7. An article of manufacture, comprising:

a computer readable storage medium having computer readable program code embodied therewith, wherein the computer readable storage medium is not a transitory signal per se, the computer readable program code comprising instructions for execution by a computer processing unit that cause the computer processing unit to:

acquire video image data over time from a plurality of synchronized cameras having overlapping views of a plurality of objects moving past the cameras and through a scene image in a linear array and with a determined speed;

generate for each camera a plurality of object detection states that each have different times of frames of the acquired video image data within a plurality of frames of the camera video stream data, wherein each of the object detection states are associated with a confidence score;

select ones of the plurality of object detection states for each of the different times that have a highest confidence score optimized by using a global energy function to find maximum unary potentials ($\psi(s_k^t)$) of the object detection states as a function of a cross-frame constraint that is defined by other confidence scores of other object detection states from the video data that are acquired by a same one of the cameras at different times from a time of the object detection state, and of a cross-view constraint ($T(s_k^t, s_l^t)$) that is defined by other confidence scores of other object detection states in the video data from another different one of the cameras that has an overlapping field-of-view with the same one camera and that are also acquired at the different times;

define an optimal state path for a detection of an object from an initial time to a final time of a duration period comprising the selected ones of the plurality of object detection states that have the highest optimized confidence scores; and determine the unary potentials $\psi(s_k^t)$ according to:

$$\psi(s_k^t)=f(s_k^t)\Pi_{t\to k}T(s_k^t,s_l^t);$$

where $f(s_k^t)$ is a confidence score of an object state $\{s_k^t\}$ returned by an object detector at view $\{k\}$; and determine the cross-view spatial constraint as a function of the unary potential according to:

$$T(s_k^t, s_l^t) = \max\begin{pmatrix} N(|s_k^t - s_l^t|; \theta_{kl}), \\ N(|s_k^t - s_l^t + \in|; \theta_{kl}) \end{pmatrix};$$

wherein $\theta_{kl}=[\mu_v(k, l), \Sigma_v(k,l)]$ for views $\{k\}$ and $\{l\}$;

"$\mu_v$" is a four-by-four matrix of mean values;

"$\Sigma_v$" is a four-by-four covariance matrix; and

"$\epsilon$" is a cross-object constraint that represents an object spacing constant defined by a sequential context of the linear array of the objects determined as a function of spatial attributes of the objects relative to the determined speed of the movement of the cameras relative to the objects.

8. The article of manufacture of claim 7, wherein the computer readable program code instructions for execution by the computer processing unit, further cause the computer processing unit to use the cross-object Spatial constraint "$\epsilon$" if the object states $\{s_k^t\}$ and $\{s_l^t\}$ for views $\{k\}$ and $\{l\}$ do not correspond to a same physical object, but instead to an adjacent object in the linear sequence.

9. The article of manufacture of claim 7, wherein the computer readable program code instructions for execution by the computer processing unit, further cause the computer processing unit to:

determine the cross-frame constraint ($\Phi(s_k^t, s_l^{v+1})$ according to:

$$\Phi(s_k^t, s_l^{t+1}) = \max\begin{pmatrix} (F(|s_k^t - s_l^{t+1}|; \lambda), \\ (F(|s_k^t - s_l^{t+1} + \in|; \lambda) \end{pmatrix};$$

wherein $\lambda=[\mu_f, \sigma_f, \mu_v, \Sigma_v, \tau]$, $<\mu_f, \sigma_f>$ and models a Gaussian distribution of an object state at a next frame given its state at the previous frame;

"$\tau$" is the determined speed of the movement of the cameras relative to the objects; and F( ) is a distance function that computes a matching score for each pair of object states ($s_k^t$, $s_l^{t+1}$), given state ($s_k^t$) at frame (t), and ($s_l^{t+1}$) at frame (t+1), wherein (k) and (l) may be different views, and wherein ($s_k^t$) and ($s_l^{t+1}$) may correspond to a same object or to two different, adjacent objects.

10. The article of manufacture of claim 7, wherein the computer readable program code instructions, for execution by the computer processing unit, further cause the computer processing unit to:

determine confidence scores for every one of the object detection states according to real-time dynamic programming formulations:

$$\chi_k^1 = \psi(s_k^1); \text{ and}$$

$$\chi_k^t = \psi(s_k^t)\frac{\max}{j}(\chi_k^{t-1}\phi(s_k^t, s_j^{t-1}));$$

at each time point, select an optimal object state ($s_v^t$) according to formulation:

$$v = \arg\frac{\max}{k}(\chi_k^t);$$

infer suboptimal object states in other camera views at each time point (t); and if no object detection is found at a time point (t), restart the steps of determining the confidence scores for the object detection states via the real-time dynamic programming formulations and select an optimal object state ($s_v^t$) at a next time point (t+1).

11. A system, comprising:

a processing unit;

a computer readable memory in communication with the processing unit; and a computer-readable storage medium in communication with the processing unit;

wherein the processing unit executes program instructions stored on the computer-readable storage medium via the computer readable memory and thereby;

acquires video image data over time from a plurality of synchronized cameras having overlapping views of a plurality of objects moving past the cameras and through a scene image in a linear array and with a determined speed;

generates for each camera a plurality of object detection states that each have different times of frames of the acquired video image data within a plurality of frames of the camera video stream data, wherein each of the object detection states are associated with a confidence score;

selects ones of the plurality of object detection states for each of the different times that have a highest confidence score optimized by using a global energy function to find maximum unary potentials ($\psi(s_k^t)$) of the object detection states as a function of a cross-frame constraint that is defined by other confidence scores of other object detection states from the video data that am acquired by a same one of the cameras at different times from a time of the object detection state, and of a cross-view constraint ($T(s_k^t, s_l^t)$) that is defined by other confidence scores of other object detection states in the video data from another different one of the cameras that has an overlapping field-of-view with the same one camera and that are also acquired at the different times;

defines an optimal state path for a detection of an object from an initial time to a final time of a duration period comprising the selected ones of the plurality of object detection states that have the highest optimized confidence scores; and determines the unary potentials $\psi(s_k^t)$ according to:

$$\psi(s_k^t)=f(s_k^t)\Pi_{t\neq k}T(s_k^t,s_l^t);$$

where $f(s_k^t)$ is a confidence score of an object state $\{s_k^t\}$returned by an object detector at view {k}; and determines the cross-view spatial constraint as a function of the unary potential according to:

$$T(s_k^t, s_l^t) = \max\begin{pmatrix} N(|s_k^t - s_l^t|; \theta_{kl}), \\ N(|s_k^t - s_l^t + \in|; \theta_{kl}) \end{pmatrix};$$

wherein $\theta_{kl}=[\mu_v(k,l), \Sigma_v(k,l)]$ for views {k} and {l};

"$\mu_v$" is a four-by-four matrix of mean values;

Σv" is a four-by-four covariance matrix; and

"ϵ" is a cross-object constraint that represents an object spacing constant defined by a sequential context of the linear array of the objects determined as a function of spatial attributes of the objects relative to the determined speed of the movement of the cameras relative to the objects.

12. The system of claim 11, wherein the processing unit executes the program instructions stored on the computer-readable storage medium via the computer readable memory, and thereby further:

determines the cross-frame constraint $(\Phi(s_k^t, s_l^{t+1})$ according to:

$$\Phi(s_k^t, s_l^{t+1}) = \max\begin{pmatrix} (F(|s_k^t - s_l^{t+1}|; \lambda), \\ (F(|s_k^t - s_l^{t+1} + \in|; \lambda) \end{pmatrix};$$

wherein $\lambda=[\mu_f, \sigma_f, \mu_v, \Sigma_v, \tau]$, $<\mu_f, \sigma_f>$ and models a Gaussian distribution of an object state at a next frame given its state at the previous frame;

"τ" is the determined speed of the movement of the cameras relative to the objects; and F( ) is a distance function that computes a matching score for each pair of object states $(s_k^t, s_l^{t+1})$, given an object state $(s_k^t)$ at frame (t), and $(s_l^{t+1})$ at frame (t+1), wherein (k) and (l) may be different views, and wherein $(s_k^t)$ and $(s_l^{t+1})$ may correspond to a same object or to two different, adjacent objects.

13. The system of claim 12, wherein the processing unit executes the program instructions stored on the computer-readable storage medium via the computer readable memory, and thereby further:

determines confidence scores for the object detection states via a batch process that infers and updates detections at other camera views by, given a set of the object states from a starting time to an ending time, computing an optimal path from the starting time to the ending time by:

determines the scores for the object detection states by using the real-time algorithm dynamic programming steps;

for each of the object detection states, stores a predecessor object detection state that obtains an optimal score;

at the ending time, selects an optimal object state;

uses the selected optimal object state to infer or update detections in other camera views at the ending time; and back-tracks to retrieve the stored predecessor object detection state at each earlier time point to obtain a full path.

* * * * *